US009005048B2

(12) United States Patent
Jertson et al.

(10) Patent No.: US 9,005,048 B2
(45) Date of Patent: Apr. 14, 2015

(54) GOLF CLUB HEADS WITH PORT STRUCTURES, TUNING ELEMENTS, AND RELATED METHODS

(71) Applicant: Karsten Manufacturing Corporation, Phoenix, AZ (US)

(72) Inventors: Martin R. Jertson, Phoenix, AZ (US); Ryan M. Stokke, Phoenix, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 54 days.

(21) Appl. No.: 13/856,700

(22) Filed: Apr. 4, 2013

(65) Prior Publication Data

US 2014/0274455 A1 Sep. 18, 2014

Related U.S. Application Data

(60) Provisional application No. 61/799,057, filed on Mar. 15, 2013.

(51) Int. Cl.

| | |
|---|---|
| ***A63B 53/04*** | (2006.01) |
| ***A63B 53/06*** | (2006.01) |
| ***A63B 59/00*** | (2006.01) |

(52) U.S. Cl.

CPC ..... *A63B 53/047* (2013.01); *A63B 53/06* (2013.01); *A63B 59/0092* (2013.01)

(58) Field of Classification Search

CPC ..... A63B 53/047; A63B 2053/0491; A63B 53/06; A63B 59/0092; A63B 2053/0454

USPC ..... 473/324–350, 287–292, 409; D21/747–749

See application file for complete search history.

(56) References Cited

U.S. PATENT DOCUMENTS

| | | | | |
|---|---|---|---|---|
| 5,282,625 | A * | 2/1994 | Schmidt et al. | 473/350 |
| 5,330,187 | A * | 7/1994 | Schmidt et al. | 473/291 |
| 6,592,469 | B2 * | 7/2003 | Gilbert | 473/350 |
| 6,709,345 | B2 * | 3/2004 | Iwata et al. | 473/291 |
| 6,835,144 | B2 | 12/2004 | Best | |
| 6,921,344 | B2 | 7/2005 | Gilbert et al. | |
| 7,083,531 | B2 * | 8/2006 | Aguinaldo et al. | 473/350 |
| 7,192,362 | B2 * | 3/2007 | Gilbert et al. | 473/291 |
| 7,396,299 | B2 | 7/2008 | Nicolette et al. | |
| 7,594,864 | B2 * | 9/2009 | Sukman | 473/334 |

(Continued)

OTHER PUBLICATIONS

International Search Report for PCT/US2014/028062, dated Jul. 2, 2014, 5 pages.

*Primary Examiner* — Sebastiano Passaniti

(57) ABSTRACT

Embodiments of golf club heads with port structures and tuning elements are presented. In some embodiments, a golf club head comprises a strikeplate comprising a strikeface and a backface opposite the strikeface, and a sole coupled to the strikeplate. The sole comprises an outer sole surface, an inner sole surface opposite the outer sole surface, a sole front section, and a sole rear section. The golf club head comprises a port structure defined by the backface and by the sole. The port structure can be configured to receive a tuning element within a port perimeter of the port structure, and comprises a port base at the backface and delimited by the port perimeter, a port rib wall protruded from the backface and bounding an upper section of the port base along the port perimeter, and a port trench extending into the sole. Other examples and related methods are also disclosed.

25 Claims, 7 Drawing Sheets

(56) References Cited

U.S. PATENT DOCUMENTS

| | | | | |
|---|---|---|---|---|
| 7,976,403 | B2 | 7/2011 | Gilbert et al. | |
| 8,197,354 | B2 | 6/2012 | Gilbert et al. | |
| 8,235,833 | B2 | 8/2012 | Best et al. | |
| 8,317,635 | B2 * | 11/2012 | Gilbert et al. | 473/335 |
| 8,337,325 | B2 | 12/2012 | Boyd et al. | |
| 8,647,218 | B2 * | 2/2014 | Gilbert et al. | 473/346 |
| 8,753,230 | B2 * | 6/2014 | Stokke et al. | 473/350 |
| 8,758,163 | B2 * | 6/2014 | Stites | 473/332 |
| 2003/0119602 | A1 | 6/2003 | Kennedy, III et al. | |
| 2005/0026716 | A1 | 2/2005 | Wahl et al. | |
| 2006/0234811 | A1 | 10/2006 | Gilbert et al. | |
| 2007/0129162 | A1 | 6/2007 | Pan et al. | |
| 2007/0225084 | A1 | 9/2007 | Schweigert et al. | |
| 2011/0250985 | A1 | 10/2011 | Stites | |
| 2012/0077613 | A1 | 3/2012 | Jertson et al. | |

* cited by examiner

GOLF CLUB HEADS WITH PORT STRUCTURES, TUNING ELEMENTS, AND RELATED METHODS

CLAIM OF PRIORITY

This application claims the benefit of U.S. Provisional Application Ser. No. 61/799,057, filed on Mar. 15, 2013. The contents of the disclosure(s) listed above are incorporated herein by reference.

TECHNICAL FIELD

The present disclosure relates generally to sports equipment, and relates, more particularly, to golf club heads with port structures and tuning elements, related methods.

BACKGROUND

Golf club heads often comprise different features that can be designed or configured to improve one or more characteristics of their respective golf club heads. For instance, tuning elements may be added to adjust or restrict impact vibrations upon impact with a golf ball, and/or to reinforce some features of the golf club. The addition of such tuning elements, however, may detrimentally affect some characteristics of the golf club heads, such as by adding extra mass, and/or by repositioning the center of gravity of the golf club head towards one or more less desirable locations.

Considering the above, further developments with respect to positioning golf club tuning elements will enhance the performance of golf clubs.

BRIEF DESCRIPTION OF THE DRAWINGS

The present disclosure may be better understood from a reading of the following detailed description of examples of embodiments, taken in conjunction with the accompanying figures.

Figure 1:
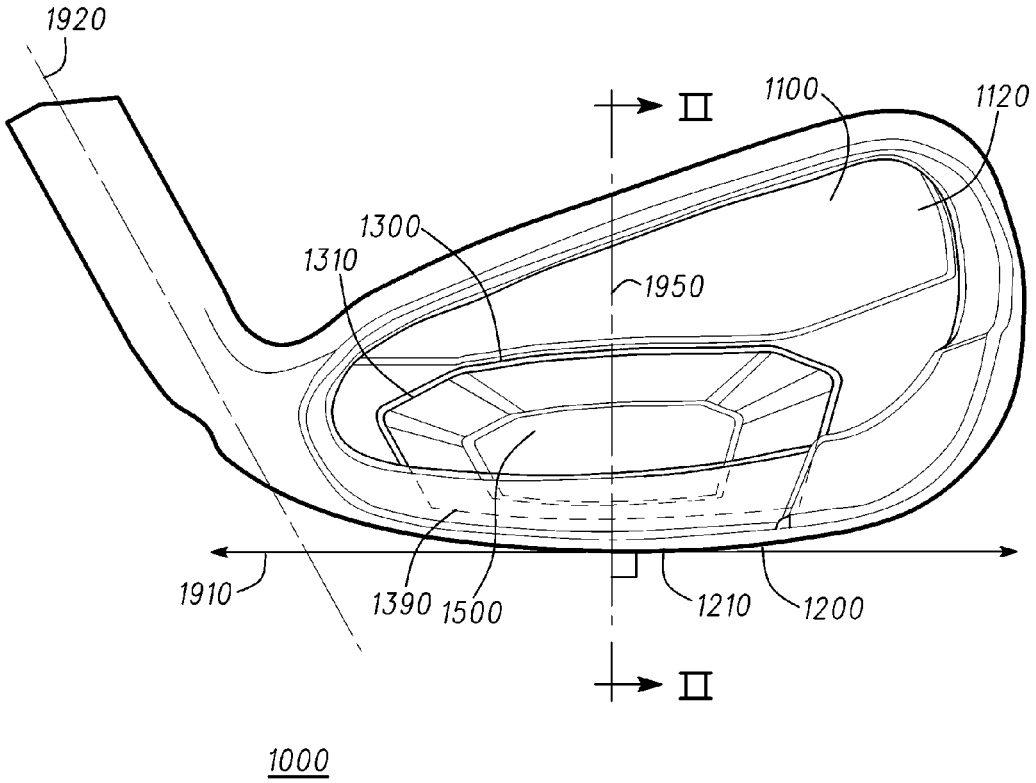
FIG. 1 illustrates a rear view of a golf club head having a port structure and a tuning element in accordance with the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DESCRIPTION

In one example, a golf club head can comprise a strikeplate comprising a strikeface and a backface opposite the strikeface, a loft plane defined by the strikeface, and a sole coupled to the strikeplate and comprising an outer sole surface, an inner sole surface opposite the outer sole surface, a sole front section, and a sole rear section. The golf club head can also comprise a tuning element, and a port structure defined by the backface and by the sole, and configured to receive the tuning element within a port perimeter of the port structure. The port rib wall can be substantially non-orthogonal to the loft plane. The strikeface comprises a strikeface centerpoint, and the backface comprises a backface centerpoint opposite the strikeface centerpoint. The port rib wall can extend along the backface within 6 mm of the backface centerpoint. The port structure can comprises a port base at the backface and delimited by the port perimeter, a port rib wall protruded from the backface and bounding an upper section of the port base along the port perimeter, and a port trench extending into the sole. The port trench can comprise a trench front wall defined by a lower section of the port base at the backface of the strikeplate, a trench bottom wall at the sole front section, coupled to the trench front wall and bounding the lower section of the port base along the port perimeter, and a trench rear wall, coupled to the trench bottom wall opposite the trench front wall, and subdividing the sole between the sole front section and the sole rear section. When the golf club head is at an address position relative to a ground surface, the trench bottom wall can be closer to the ground plane than any point of the sole rear section along the inner sole surface. A trench bottom rear angle between the trench bottom wall and the trench rear wall can be greater than a trench bottom front angle between the trench bottom wall and the trench front wall. When the tuning element is seated against the port base and bounded by the port rib wall, at least a majority of the trench rear wall can be decoupled from the tuning element. The tuning element can be pivotable along the trench bottom wall, from a pivot position to a secured position where a tuning element front end of the tuning element can contact the port base, and where the tuning element top end can bounded by the port rib wall.

In one example, a method for providing a golf club head can comprise providing a strikeplate comprising a strikeface and a backface opposite the strikeface, and providing a sole coupled to the strikeplate and comprising an outer sole surface, an inner sole surface opposite the outer sole surface, a sole front section, and a sole rear section. The method can further comprise providing a port structure defined by the backface and by the sole, and configured to receive the a tuning element within a port perimeter of the port structure, and coupling the tuning element to the port structure. The port structure can comprise a port base at the backface and delimited by the port perimeter, a port rib wall protruded from the backface and bounding an upper section of the port base along the port perimeter, and a port trench extending into the sole. The port trench can comprise a trench front wall defined by a lower section of the port base at the backface of the strikeplate, a trench bottom wall at the sole front section, coupled to the trench front wall and bounding the lower section of the port base along the port perimeter, and a trench rear wall, coupled to the trench bottom wall opposite the trench front wall, and subdividing the sole between the sole front section and the sole rear section. The trench rear wall can be non-parallel to the trench front wall. The port rib wall can be substantially non-orthogonal to a loft plane defined by the strikeface.

In one embodiment, a golf club head can comprise (1) a strikeplate comprising a strikeface and a backface opposite the strikeface, (2) a sole coupled to the strikeplate and comprising an outer sole surface, an inner sole surface opposite the outer sole surface, a sole front section, and a sole rear section, and (3) a port structure defined by the backface and by the sole, and configured to receive a tuning element within a port perimeter of the port structure. The port structure can comprise a port base at the backface and delimited by the port perimeter, a port rib wall protruded from the backface and bounding an upper section of the port base along the port perimeter, and a port trench extending into the sole. The port trench can comprise a trench front wall defined by a lower section of the port base at the backface of the strikeplate, a trench bottom wall at the sole front section, coupled to the trench front wall and bounding the lower section of the port base along the port perimeter, and a trench rear wall, coupled to the trench bottom wall opposite the trench front wall, and subdividing the sole between the sole front section and the sole rear section. The trench bottom wall can be closer to the outer sole surface than a top end of the trench rear wall.

Other examples and embodiments are further disclosed herein. Such examples and embodiments can be found in the figures, in the claims, and/or in the present description.

Figure 2:
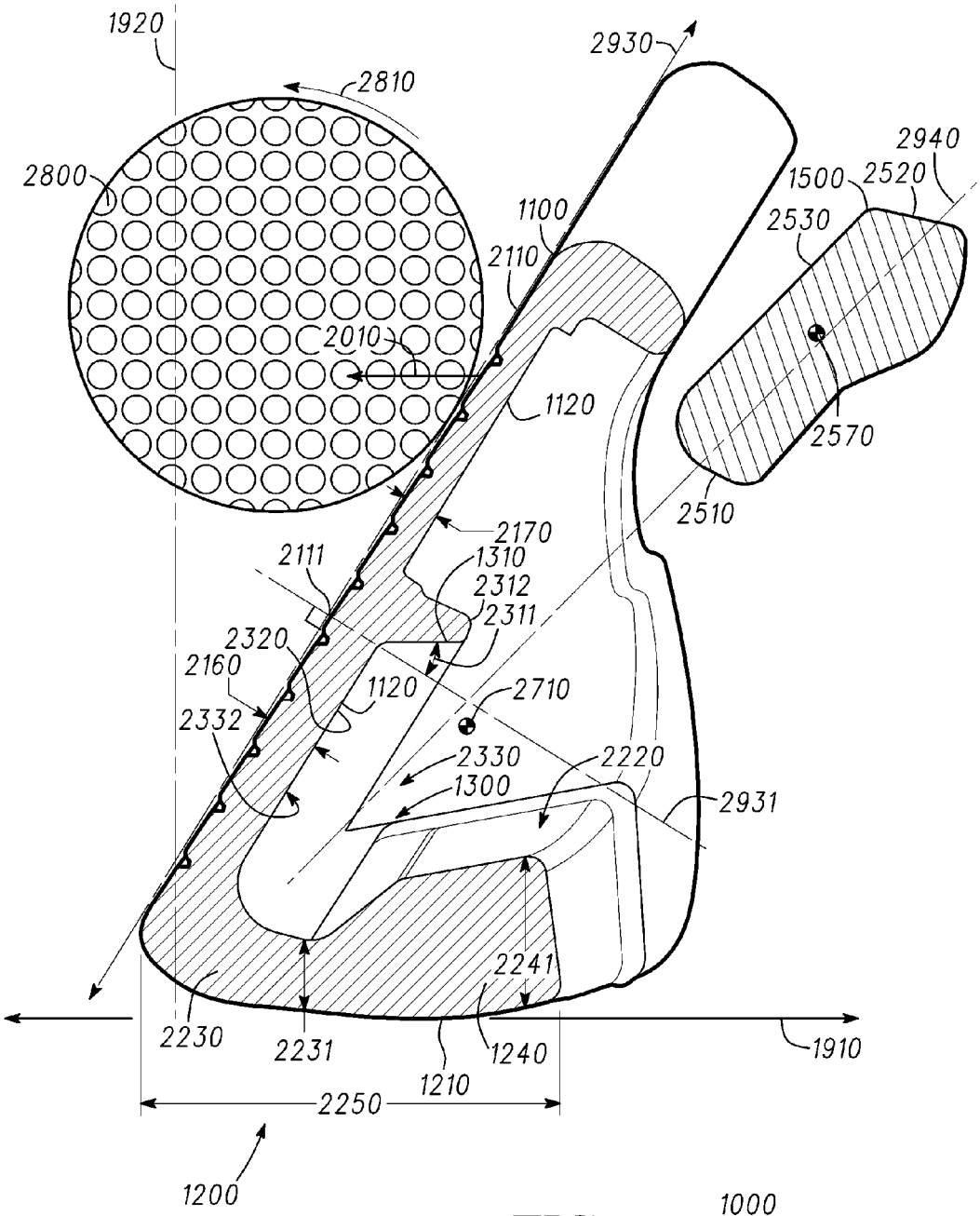
FIG. 2 illustrates a side cross-sectional view of the golf club head along line II-II in FIG. 1, showing the tuning element decoupled from the port structure.
Figure 3:
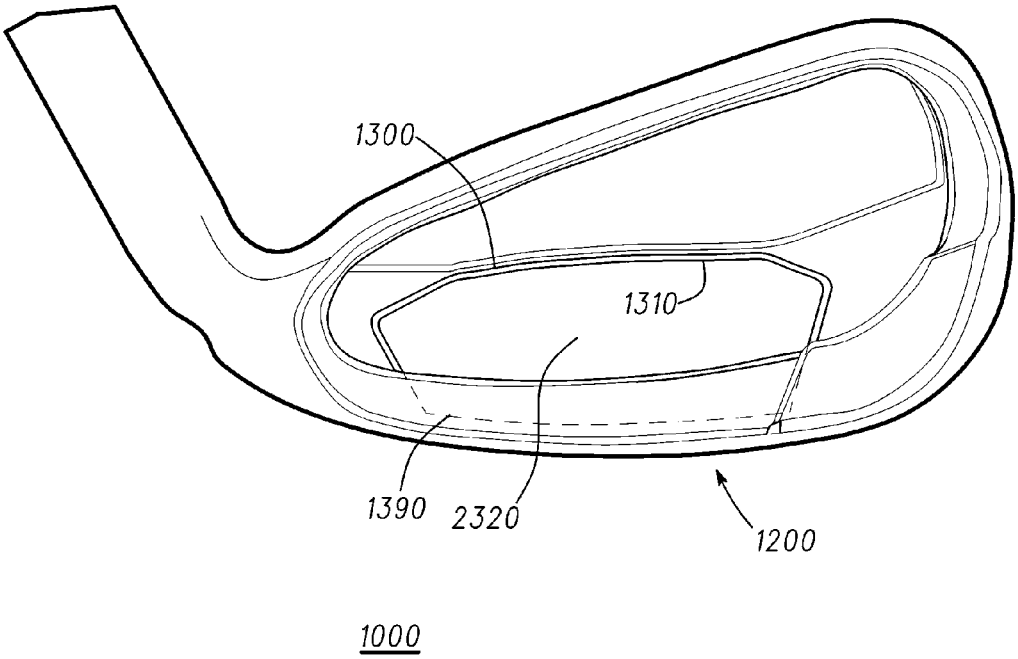
FIG. 3 illustrates a rear view of the golf club head of FIGS. 1-2, without the tuning element.
Figure 7:
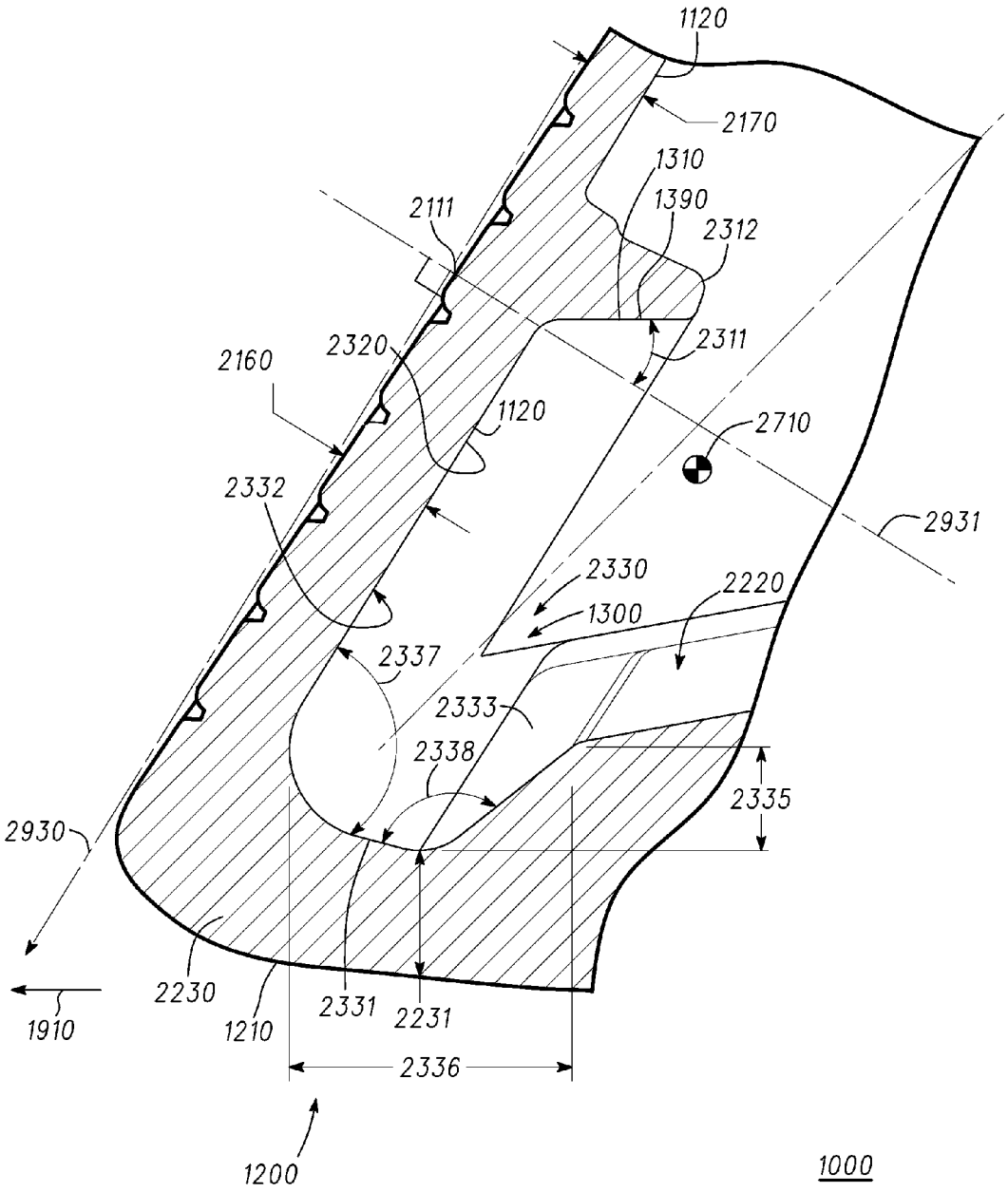
FIG. 7 illustrates a detail view of a portion of FIG. 2, focusing on the port structure of the club head.

Turning to the drawings, FIG. 1 illustrates a rear view of club head 1000 comprising tuning element 1500 secured in port structure 1300. FIG. 2 illustrates a cross-sectional view of club head 1000 (without tuning element 1500 inserted in port structure 1300) along line II-II of FIG. 1. For further detail, FIG. 7 illustrates a zoomed-in view of a portion of FIG. 2, focusing on the port structure 1300 of club head 1000. FIG. 3 illustrates a rear view of golf club head 1000, without tuning element 1500. Club head 1000 comprises an iron club head in the present embodiment, but there can be other examples where a port structure similar to port structure 1300 can be implemented without departing from the scope of the present disclosure. In the present example, club head 1000 comprises strikeplate 1100, having strikeface 2110 and backface 1120 opposite each other, and sole 1200 coupled to strikeplate 1100. In the present example, sole 1200 and strikeplate 1100 comprise a single piece of material, but there can be other embodiments where strikeplate 1100 can be a separate piece of material fastened to sole 1200 and/or to a body of golf club head 1000.

Sole 1200 comprises outer sole surface 1210 facing a bottom of club head 1000, and inner sole surface 2220 opposite outer sole surface 1210. Sole 1200 also comprises sole front section 2230 towards strikeplate 1100, and sole rear section 1240 towards a rear end of club head 1000. In the present example sole 1200 defines part of port structure 1300, which is also defined by backface 1120 of strikeface 1100. Sole 1200 can comprise one or more materials, including ferrous material(s) like steel, carbon steel, stainless steel, and/or steel alloys, and/or non-ferrous material(s) like titanium, tungsten, and/or aluminum. In some example, the material(s) of sole 1200 can comprise a density of approximately 2.8 g/cc (grams per cubic centimeter) to approximately 18 g/cc.

Port structure 1300 is configured to receive and secure tuning element 1500 within port perimeter 1390. Tuning element 1500 comprises a weight in the present example, which can be configured to reinforce strikeplate 1100, to minimize unwanted impact vibration, and/or to establish or adjust golf club swingweight during assembly. Tuning element 1500 can have a mass of approximately 1 gram to approximately 40 grams, and a density of approximately 1 g/cc to approximately 9 g/cc. The density of tuning element 1500 is less than the density of the one or more materials in sole 1200 in the present embodiment. There can be other embodiments, however, where the density of tuning element 1500 can be equal to or greater than the density of the one or more materials in sole 1200 if desired.

In the present embodiment, port structure 1300 comprises port base 2320 at backface 1120 of strikeplate 1100, where port base 2320 is delimited by port perimeter 1390 and is configured to receive tuning element front end 2530 of tuning element 1300 when tuning element 1300 is secured by port structure 1300. In the present example, port base 2320 comprises part of backface 1120, but there can be other embodiments where port base 2320 and backface 1120 can be a separate pieces coupled together, such as via welding, brazing, adhering, and/or other mechanical or chemical fasteners.

Port structure 1300 also comprises port rib wall 1310 and port trench 2330 bounding port base 2320 around port perimeter 1390. Port rib wall 1310 protrudes from backface 1120 and bounds an upper section of port base 2320 along port perimeter 1390. Although in the present example port rib wall 1310 is integral and comprises a single piece with strikeplate 1100, there can be other examples where port rib wall 1310 can be a separate piece coupled to backface 1120, such as via welding, brazing, adhering, and/or other mechanical or chemical fasteners.

Port structure 1300 further comprises port trench 2330, which is configured to extend into sole 1200 towards outer sole surface 1210 so that tuning element 1500 can be located and secured by port structure 1300 closer to the bottom end of club head 1000. Port trench 2330 comprises trench bottom wall 2331, which bounds a lower section of port base 2320 along port perimeter 1390, and which is located at sole front section 2230 adjacent to backface 1120 of strikeplate 1100. Port trench 2330 also comprises trench front wall 2332 and trench rear wall 2333, each at opposite sides of trench bottom wall 2331. In the present example, trench front wall 2332 is defined by a lower section of port base 2320, which can be part of backface 1120 of strikeplate 1100 as described above. Trench rear wall 2333 is located opposite trench front wall 2332 and away from port base 2320, and can subdivide sole 1200 between sole front section 2230 and sole rear section 1240.

As can be seen in FIG. 2, trench front wall 2332 and trench rear wall 2333 are angled relative to trench bottom wall 2331 and extend therefrom towards the top end of club head 1000. Accordingly, trench bottom wall 2331 is closer to outer sole surface 1210 than the top ends of trench rear wall 2333 and trench front wall 2332.

Sole 1200 comprises sole trench thickness 2231 of sole front section 2230, measured between outer sole surface 1210 and trench bottom wall 2331. In some examples, sole trench thickness 2231 can be approximately 1.0 mm (millimeters) to approximately 5.1 mm. Sole 1200 also comprises sole maximum thickness 2241 at sole rear section 1240, measured between outer sole surface 1210 and inner sole surface 2220. In the same or other examples, sole maximum thickness 2241 can be approximately 2.5 mm to approximately 11 mm. There can also be examples where sole maximum thickness 2241 can be at least approximately 125% greater than sole trench thickness 2231.

As seen in FIG. 7, port trench 2330 also comprises port trench height 2335 and port trench width 2336. Port trench height 2335 can be measured between a lowest point of trench bottom wall 2331 and a top end of trench rear wall 2333, while port trench width 2336 can be measured between trench front wall 2332 and the top end of trench rear wall 2333. In the present example, port trench height 2335 can be approximately 0.75 mm to approximately 6.0 mm. In addition, port trench width 2336 can be of approximately 5.0 mm to approximately 18 mm. In the same or other examples, a volume of port trench 2330 can be of approximately 0.5 cc (cubic centimeters) to approximately 8 cc.

Sole trench thickness 2231, sole maximum thickness 2241, port trench height 2335, port trench width 2336, and/or other measurements with respect to the different features of port structure 1300 can be measured along vertical centerplane 1950 (FIG. 1), which comprises line II-II along which golf club head 1000 is cross-sectioned for the view of FIG. 2. Vertical centerplane 1950 is orthogonal to ground plane 1910 and to loft plane 2930, extends through strikeface centerpoint 2111 of strikeface 2110, and extends through port trench 2330 of port structure 1300.

In some embodiments, when club head 1000 is at an address position relative to ground surface 1910, trench bottom wall 2331 is closer to ground plane 1910 than any other point of sole rear section 1240 along inner sole surface 2220. In such examples, the address position can be as shown in FIGS. 1-5 where hosel axis 1920 of club head 1000 can be at a 60-degree angle with ground plane 1910 with respect to a rear view of golf club head 1000 (FIG. 1), and where hosel axis 1920 can be substantially orthogonal to ground surface 1910 with respect to a side view of golf club head 1000 (FIG. 2).

The configuration described above with respect to port structure 1300 having port trench 2330 thereof can permit several performance improvements for club head 1000, such as by allowing tuning element 1500 to be located closer to outer sole surface 1210 and/or closer ground plane 1910, and/or such as by allowing some sole mass, which would have otherwise filled port trench 2330, to be redistributed throughout club head 1000 for better performance. For example, because port trench 2330 is located at sole front section 2230 and adjacent to backface 1120 of strikeplate 1100, the sole mass redistributed from port trench 2330 would have otherwise tended to shift head center of gravity 2710 of club head 1000 towards strikeface 2110. Accordingly, the sole mass removed or redistributed out of port trench 2330 can locate head center of gravity 2710 further backwards relative to strikeface 2110 for increased dynamic loft and launch angle.

Figure 5:
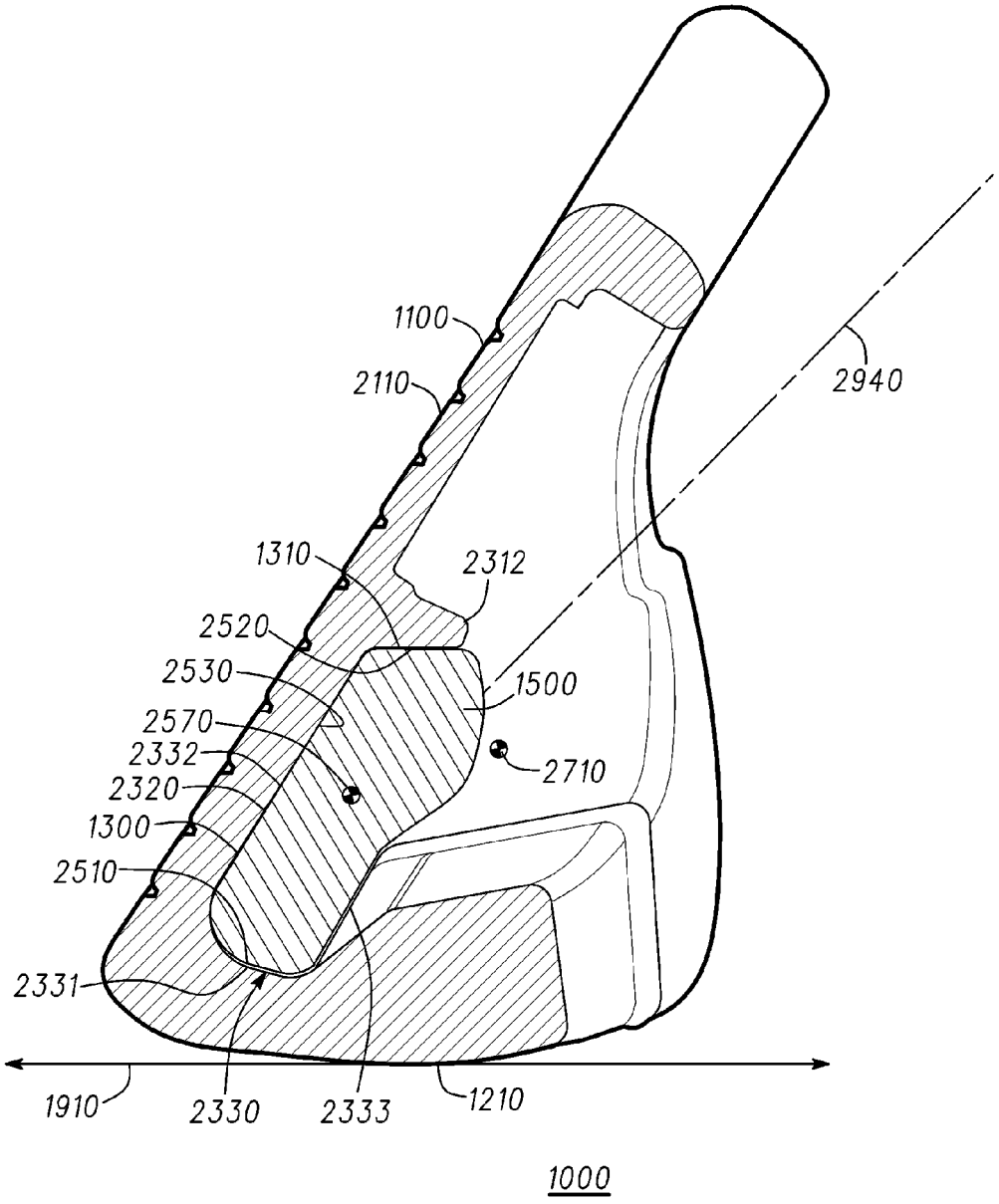
FIG. 5 illustrates a further side cross-sectional view of the golf club head along line II-II in FIG. 1, with the tuning element pivoted into a secured position at the port structure.

In the same or other examples, as seen in FIG. 5, by permitting tuning element 1500 to be located at least partially in port trench 2330, center of gravity 2570 of tuning element 1500 can be located closer to outer sole surface 1210 than if port trench 2330 had otherwise remained filled with mass from sole 1200. Such lower placement of tuning element 1500 in turn causes head center of gravity 2710 to be lowered as well to be closer to ground plane 1910 when golf club head 1000 is at the address position, thereby increasing gear effect 2810 upon impact between strikeface 2110 and ball 2800 to decrease the backspin of ball 2800 and increase golf shot distance.

Furthermore, because tuning element 1500 is supported by trench 2330, no additional bottom support rib wall is required to support tuning element bottom end 2510, thereby saving mass that, along with the mass from sole 1200 eliminated from port trench 2330, can be redistributed towards heel or toe ends of club head 1000 for increased moment of inertia and forgiveness with respect to golf shots where golf ball 2800 contacts strikeface 2110 in an off-center manner. In some examples, whether due to the mass of sole 1200 eliminated from the volume of port trench 2330, and/or due to the elimination of a bottom support rib wall as described above, the implementation of port structure 1300 can liberate approximately 1 grams to approximately 15 grams of mass for redistribution across golf club head 1000 to improve performance.

In some embodiments, the implementation of port structure 1300 described above can also permit sole depth 2250 (FIG. 2) of sole 1200 to be narrowed. For example, port structure 1300 permits repositioning of mass, which would otherwise be located proximate to the transition between strikeplate 1100 and sole 1200, towards the back of sole rear section 1240. Accordingly, the configuration of port structure 1300 liberates discretionary mass that can be redistributed towards the back of club head 1000. The ability to reposition mass in this manner can have a large effect on adjusting head center of gravity 2710. Mass that would ordinarily be located within port trench 2330 and/or near strikeface 2110, and which would draw the head center of gravity 2710 forward, can instead be repositioned towards the back of golf club head 1000 to draw head center of gravity 2710 rearwards. Thus, sole 1200 can be configured such that sole depth 2250 is narrower than that of a corresponding wider sole lacking port structure 1300 and/or port trench 2330, while still exhibiting similar or improved location for head center of gravity 2710.

In the present example, sole depth 2250 can be measured along vertical centerplane 1950 (FIG. 1, defining the cross-section of FIG. 2), with club head 1000 at the address position having hosel axis 1920 substantially orthogonal to ground surface 1910 with respect to the side view of FIG. 2. In such configuration, sole depth 2250 can be measured, along vertical centerplane 1950 and parallel to ground surface 1910, from the front edge of club head 1000 to the rear end of sole 1200. There also can be examples where sole depth 2250 can be measured as described above, but instead along a vertical plane parallel to vertical center plane 1950, where such vertical plane can extend through port trench 2330 of port structure 1300 and along a widest distance between the front edge of club head 1000 to the rear end of sole 1200. Sole depth 2250 can be approximately 23 mm in the present example, where the body of golf club head 1000 can be that of a 7-iron. In the same or other examples, however, sole depth 2250 can be approximately 16 mm to approximately 33 mm.

The thickness of strikeplate 1100 also can vary in some embodiments depending on where it is measured, where such variation can permit reinforcement of specific portions of strikeface 2110 as needed for better strength and/or for impact sound considerations. In the present example, strikeplate 1100 comprises strikeplate thickness 2160 between strikeface 2110 and port base 2320 below port rib wall 1310, and further comprises strikeplate thickness 2170 between strikeface 2110 and backface 1120 above port rib wall 1310. Strikeplate thickness 2160 is approximately 2.9 mm, while strikeplate thickness 2170 is approximately 1.9 mm in the present implementation, but there can be other examples where strikeplate thickness 2160 and/or strikeplate thickness 2170 can be of approximately 5.7 mm to approximately 1.1 mm. As seen in FIG. 2, strikeplate thickness 2160 is greater than strikeplate thickness 2170 in the present implementation. Such extra thickness of strikeplate thickness 2160 can be configured to reinforce the region of strikeplate 1100 undergoing peak stress during golf impact, which can help to improve consistency and durability. There can be other examples, however, where strikeplate thicknesses 2160 and 2170 of strikeplate 1100 can be substantially equal to each other, or where strikeplate thickness 2170 can be greater than strikeplate thickness 2160.

The configuration of port structure 1300 can reduce the amount of impact deflection experienced by strikeplate 1100 when impacting a golf ball. For example, port structure 1300 permits tuning element 1500 to be positioned at a lower height over sole 1200, thus permitting port rib wall 1310 to couple with sole 1200 towards the heel and toe portions of backface 1120 for better structural support Furthermore, port rib wall 1310 can also be angled as described below for improved resistance to impact stresses. Due to such characteristics, the overall thickness of strikeplate 1100 to be reduced without affecting performance or structural integrity.

As can be seen in FIG. 2, club head 1000 comprises loft orthogonal axis 2931 orthogonal to loft plane 2930 and intersecting the junction between port rib wall 1310 and backface 1120. Port rib wall 1310 is non-orthogonal to loft plane 2930 of strikeface 2110 in the present example. In particular, port rib angle 2311, between port rib wall 1310 and loft orthogonal axis 2931, is approximately 25 degrees in the present example but can be approximately 10 degrees to approximately 40 degrees in the same or other examples. Angling port rib wall 1310 non-orthogonal to loft plane 2930 can permit port rib wall 1310 to better absorb or dissipate impact stresses at strikeface 2110, and/or to better reinforce strikeplate 1100 with respect to the club head's direction at impact with ball 2800, thereby permitting further narrowing of strikeplate thicknesses 2160 and/or 2170 without compromising durability or strength considerations. In some embodiments, port rib wall 1310 can extend along backface 1120 substantially opposite a target impact area of strikeface 2110. For instance, in the present example, where port rib wall 1310 intersects vertical centerplane 1950 (FIG. 1) as seen in the cross-section of FIG. 2, port rib wall 1310 is proximate to a centerpoint of backface 1120 opposite strikeface centerpoint 2111. In some examples, port rib wall 1310 can extend along backface 1120 within 6 mm of the centerpoint of backface 1120.

In some examples, when golf club head 1000 is at the address position over ground plane 1910, port rib wall 1310 can be substantially parallel to ground plane 1910 and/or within ±35 degrees of being parallel to ground plane 1910. There can also be examples where port rib wall 1310 can be angled with respect to a target impact head direction 2010 for golf club head 1000 at impact with golf ball 2800. For example, target impact head direction 2010 can be substantially parallel to ground plane 1910 in some examples, or can be angled otherwise based on whether a target user is expected to impact golf ball 2800 during the downswing or during the upswing of the user's golf swing. For instance, target impact head direction 2010 can comprise a downswing direction angle of approximately −45 degrees to approximately zero degrees relative to the ground plane 1910, or an upswing direction angle of approximately zero degrees to approximately 15 degrees relative to the ground plane 1910. Port rib wall 1310 can be angled to be substantially parallel, and/or within ±45 degrees of being parallel, to target impact head direction 2010.

Figure 4:
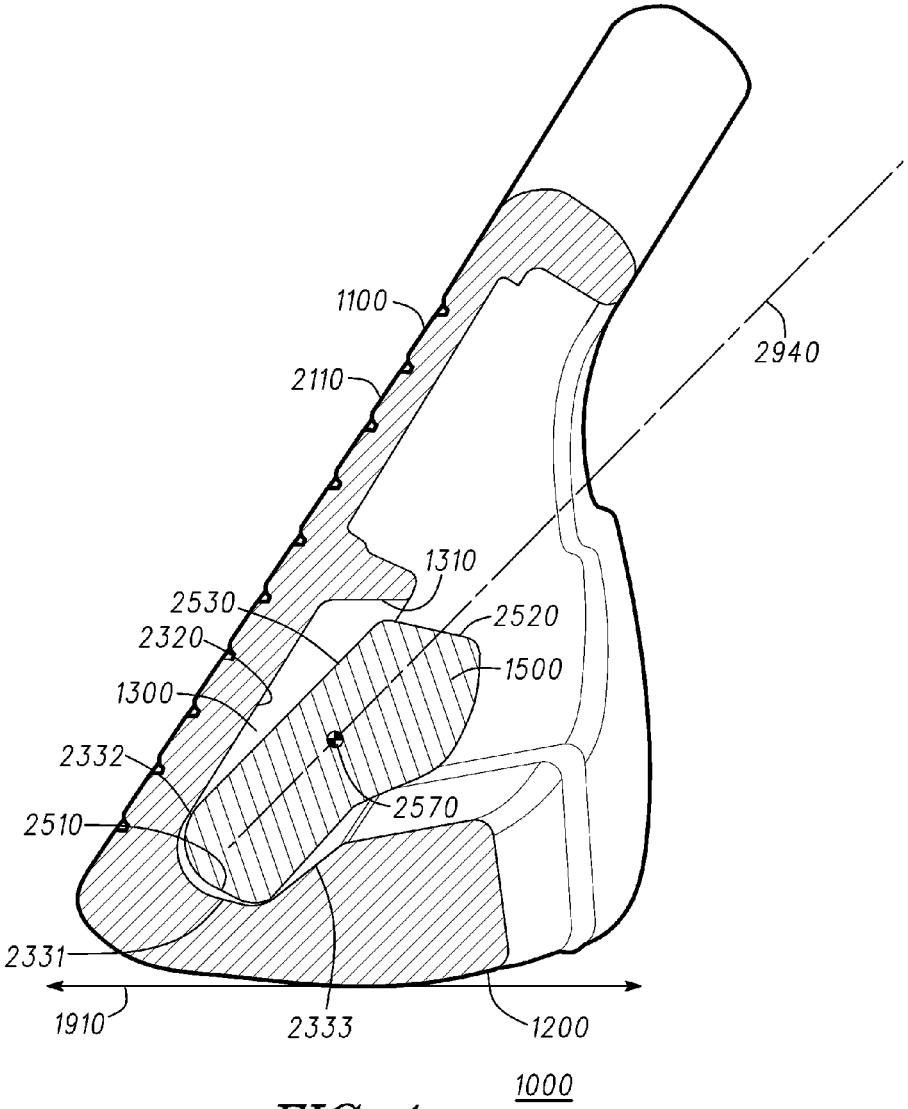
FIG. 4 illustrates another side cross-sectional view of the golf club head, with the tuning element being inserted into a pivot position at the port structure.

As can be seen in FIGS. 2, 4, and 5, port structure 1300 comprises a pivoting mechanism designed to permit insertion of tuning element 1500 into port trench 2330 without interference from port rib wall 1310. For example, FIG. 2 shows how port rib wall 1310 comprises port rib wall rear end 2312 towards a rear end of golf club head 1000, and how trench rear wall 2333 is non-parallel to trench front wall 2332 and is instead angled to facilitate the approach of tuning element bottom end 2510 into port trench 2330. As seen in FIG. 7, port trench 2330 comprises bottom front angle 2337 between trench bottom wall 2331 and trench front wall 2332, and bottom rear angle 2338 between trench bottom wall 2331 and trench rear wall 2333, where bottom rear angle 2338 is greater than bottom front angle 2337, thereby permitting an angled approach that will clear port rib wall rear end 2312 as tuning element 1500 is inserted into port trench 2330. In some examples, bottom rear angle 2338 of port trench 2330 can also set trench rear wall 2333 substantially parallel to insertion axis 2940, along which tuning element 1500 cab be inserted into port trench 2330 unobstructed by port rib wall 1310. FIG. 2 shows tuning element 1500 still decoupled from golf club head 1000, but lined up along insertion axis 2940 for insertion into port structure 1300.

FIG. 4 shows tuning element 1500 coupled to port structure 1300 in a pivot position, where tuning element bottom end 2510 reaches trench bottom wall 2331 after having been inserted along insertion axis 2940. The pivot position shown in FIG. 4 illustrates how tuning element 1500, including tuning element top end 2520, has cleared port rib rear end 2312 through insertion via insertion axis 2940, such that tuning element top end 2520 is closer to sole 1200 than port rib wall 1310. In the present example, insertion axis 2940 extends from trench bottom wall 2331 and past rib wall 1310 without traversing through port rib wall 1310 or trench rear wall 2333.

FIG. 5 shows tuning element 1500 coupled to port structure 1300 in a secured position, after having been pivoted thereto along trench bottom wall 2331 such that tuning element front end 2530 contacts port base 2320 and such that tuning element top end 2520 is bounded by port rib wall 1310. As can be seen in FIG. 5, because of the pivoting mechanism described above, when tuning element 1500 is coupled to port structure 1300 in the secured position, a majority of trench rear wall 2333, including the top end thereof, remains decoupled from tuning element 2500 while tuning element 2500 is secured within port structure 1300.

Figure 6:
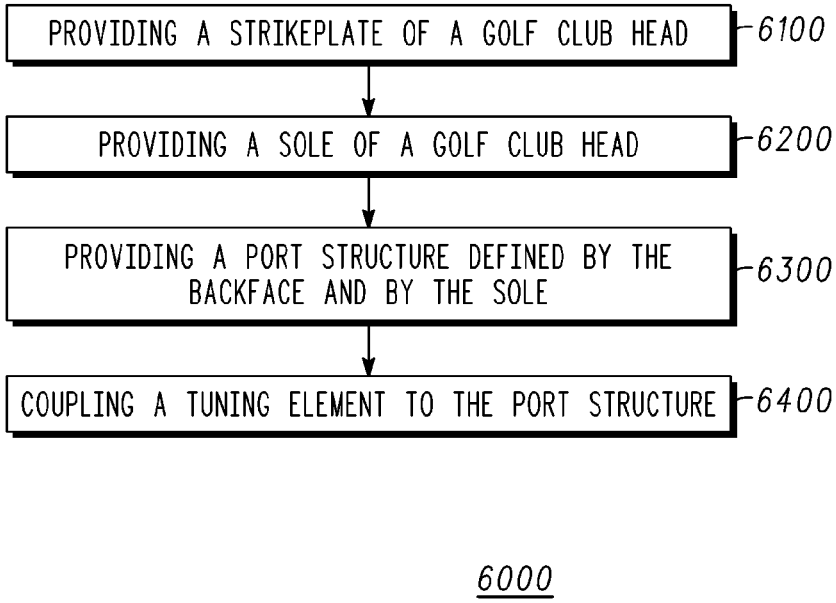
FIG. 6 illustrates a flowchart for a method that can be used to provide, form, and/or manufacture a golf club head in accordance with the present disclosure.

FIG. 6 illustrates a flowchart for method 6000, which can be used to provide, form, and/or manufacture a golf club head in accordance with the present disclosure. In some examples, the golf club head can be similar to golf club head 1000 (FIGS. 1-5) presented above.

Method 6000 comprises block 6100 for providing a strikeplate of a golf club head. In some examples, the strikeplate can be similar to strikeplate 1100 (FIGS. 1-5). The strikeplate can comprise a strikeface centerpoint similar to strikeface centerpoint 2111 (FIG. 2). In some examples, the strikeface centerpoint can be located at a geometric centerpoint of the strikeface, whether at a midpoint between the top and bottom ends of the strikeface, and/or at a midpoint between the toe and heel ends of the strikeface. In the same or other examples, the strikeface centerpoint can be located in accordance with the definition of a golf governing body such as the United States Golf Association (USGA). For example, the strikeface centerpoint can be determined in accordance with Section 6.1 of the USGA's Procedure for Measuring the Flexibility of a Golf Clubhead (USGA-TPX3004, Rev. 1.0.0, May 1, 2008) (http://www.usga.org/equipment/testing/protocols/Procedure-For-Measuring-The-Flexibility-Of-A-Golf-Club-Head/)

Block 6200 of method 6000 comprises providing a sole of a golf club head. In some examples, the sole can be similar to sole 1200 (FIGS. 1-5). The sole and the strikeplate can comprise a single piece of material, and can thus be inherently coupled when formed together. In other examples, the sole and the strikeplate can comprise separate pieces that are then coupled together in block 6200.

Method 6300 also comprises 6300 for providing a port structure defined by a backface of the strikeface of block 6100 and by the sole of block 6200. In some examples, the port structure can be similar to port structure 1300 (FIGS. 1-5), and can comprise feature(s) such as or similar to port base 2320 (FIGS. 2, 4, 5), port rib wall 1310 (FIGS. 2, 4, 5), and/or port trench 2330 (FIGS. 2, 4, 5).

Method 6000 can also comprise block 6400 for coupling a tuning element to the port structure. In some examples, the tuning element can be similar to tuning element 1500 (FIGS. 1-5). In the same or other examples, the tuning element can be coupled to the port of block 6300 as described above with respect to the coupling of tuning element 1500 (FIGS. 1-5) to port structure 1300 (FIGS. 1-5). For example, the tuning element can be inserted along an insertion axis, unobstructed by any port rib wall of the port structure, into a pivot position at a port trench of the port structure. The tuning element can be then pivoted along the port trench into a secured position at the port structure. In some embodiments, the pivot position can be similar to that described above with respect to FIG. 4. In the same or other embodiments, the pivot position can be similar to that described above with respect to FIG. 5. The tuning element can be maintained at the secured position via one or more mechanisms, such as friction forces and/or adhesives between the tuning element and the port rib wall and/or the port trench of the port structure, and/or such as mechanical fasteners attaching the tuning element to one or more features of the port structure. In the same or other examples, the tuning element can be removable from the secured position at the port structure, and/or can be interchangeable with one or more other tuning elements.

In some examples, one or more of the different blocks of method 6000 can be combined into a single block or performed simultaneously, and/or the sequence of such blocks can be changed. For example, blocks 6100, 6200, and/or 6300 can be combined or performed simultaneously in some embodiments. In the same or other examples, some of the blocks of method 6000 can be subdivided into several sub-blocks. For example, block 6400 can be subdivided into a sub-block for inserting the tuning element into a pivot position with the port structure, and another sub-block for pivoting the tuning element into a secured position with the port structure. There can also be examples where method 6000 can comprise further or different blocks. As an example, method 6000 can comprise another block for providing or coupling a golf club shaft to the golf club head. In addition, there can be examples where method 6000 can comprise only part of the blocks described above. For example, block 6400 can be optional in some implementations, such as in situations where the tuning element is not needed or desired, or in situations where the decision of whether to couple a tuning element to the port structure is left up to a player or end user. Other variations can be implemented for method 6000 without departing from the scope of the present disclosure.

Although the golf club heads with port structures, tuning elements, and related methods herein have been described with reference to specific embodiments, various changes may be made without departing from the spirit or scope of the present disclosure. For instance, while the above examples may be described in connection with an iron-type golf club, the apparatus, methods, and articles of manufacture described herein may be applicable to other types of golf club such as a fairway wood-type golf club, a hybrid-type golf club, a driver-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads with port structures, tuning elements, and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a strikeplate comprising:
a strikeface; and
a backface opposite the strikeface;
a sole coupled to the strikeplate and comprising:
an outer sole surface;
an inner sole surface opposite the outer sole surface;
a sole front section; and
a sole rear section;
and
a port structure defined by the backface and by the sole, and configured to receive a tuning element within a port perimeter of the port structure;
wherein:
the port structure comprises:
a port base at the backface and delimited by the port perimeter;
a port rib wall protruded from the backface and bounding an upper section of the port base along the port perimeter; and
a port trench extending into the sole and comprising:
a trench front wall defined by a lower section of the port base at the backface of the strikeplate;
a trench bottom wall at the sole front section, coupled to the trench front wall and bounding the lower section of the port base along the port perimeter;
a trench rear wall, coupled to the trench bottom wall opposite the trench front wall, and subdividing the sole between the sole front section and the sole rear section;
a port trench height, between the trench bottom wall and a top end of the trench rear wall, of approximately 0.75 mm to approximately 6.0 mm; and
a port trench top width, between the trench front wall and the top end of the trench rear wall, of approximately 5.0 mm to approximately 18 mm;
and
the trench bottom wall is closer to the outer sole surface than a top end of the trench rear wall.

2. The golf club head of claim 1, further comprising:
a loft plane defined by the strikeface;
wherein the port rib wall is substantially non-orthogonal to the loft plane.

3. The golf club head of claim 2, wherein:
a loft orthogonal axis extends orthogonal to the loft plane and intersects a junction between the backface and the port rib wall; and
a port rib angle, from the port rib wall to the loft orthogonal axis, is approximately 10 degrees to approximately 40 degrees.

4. The golf club head of claim 3, wherein:
the port rib angle is approximately 25 degrees.

5. The golf club head of claim 1, wherein:
the sole comprises:
a sole trench thickness measured at the sole front section between the outer sole surface and the trench bottom wall; and
a sole maximum thickness measured at the sole rear section between the outer sole surface and the inner sole surface;
and
the sole maximum thickness is at least 125% greater than the sole trench thickness.

6. A golf club head comprising:
a strikeplate comprising:
a strikeface; and
a backface opposite the strikeface;
a sole coupled to the strikeplate and comprising:
an outer sole surface;
an inner sole surface opposite the outer sole surface;
a sole front section; and
a sole rear section;
and
a port structure defined by the backface and by the sole, and configured to receive a tuning element within a port perimeter of the port structure;
wherein:
the port structure comprises:
a port base at the backface and delimited by the port perimeter;
a port rib wall protruded from the backface and bounding an upper section of the port base along the port perimeter; and
a port trench extending into the sole and comprising:
a trench front wall defined by a lower section of the port base at the backface of the strikeplate;
a trench bottom wall at the sole front section, coupled to the trench front wall and bounding the lower section of the port base along the port perimeter; and
a trench rear wall, coupled to the trench bottom wall opposite the trench front wall, and subdividing the sole between the sole front section and the sole rear section;
the strikeplate further comprises:
a first thickness between the strikeface and the backface above the port rib wall; and
a second thickness between the strikeface and the port base below the port rib wall;
the second thickness is greater than the first thickness;
and
the trench bottom wall is closer to the outer sole surface than a top end of the trench rear wall.

7. A golf club head comprising:
a strikeplate comprising:
a strikeface; and
a backface opposite the strikeface;
a sole coupled to the strikeplate and comprising:
an outer sole surface;
an inner sole surface opposite the outer sole surface;
a sole front section; and
a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section; and when the golf club head is at address over a ground plane, the port rib wall is within ±35 degrees of being substantially parallel to the ground plane;

and the trench bottom wall is closer to the outer sole surface than a top end of the trench rear wall.

8. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section;

when the golf club head is at address over a ground plane, the port rib wall is substantially parallel to a target impact head direction;

the target impact head direction comprises at least one of:

a downswing direction angle of approximately −45 degrees to approximately zero degrees relative to the ground plane; or an upswing direction angle of approximately zero degrees to approximately 15 degrees relative to the ground plane;

and the trench bottom wall is closer to the outer sole surface than a top end of the trench rear wall.

9. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section;

the sole further comprises:

a sole trench thickness of approximately 1.0 mm to approximately 5.1 mm, measured at the sole front section between the outer sole surface and the trench bottom wall; and a sole maximum thickness of approximately 2.5 mm to approximately 11 mm, measured at the sole rear section between the outer sole surface and the inner sole surface;

and the trench bottom wall is closer to the outer sole surface than a top end of the trench rear wall.

10. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section;

a port trench height, between the trench bottom wall and a top end of the trench rear wall, of approximately 0.75 mm to approximately 6.0 mm; and a port trench top width, between the trench front wall and the top end of the trench rear wall, of approximately 5.0 mm to approximately 18 mm;

and the trench bottom wall is closer to the outer sole surface than a top end of the trench rear wall.

11. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter;

a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section; and the port trench comprises a port trench volume of approximately 0.5 cc to approximately 8 cc; and a liberated mass of approximately 1 gram to approximately 15 grams is liberated by the port structure for redistribution or elimination; and the liberated mass comprises a trench liberated mass defined by the port trench volume and a sole density of a material of the sole;

and the trench bottom wall is closer to the outer sole surface than a top end of the trench rear wall.

12. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter;

a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section; and the sole comprises a sole depth of approximately 16 mm to approximately 33 mm;

and the trench bottom wall is closer to the outer sole surface than a top end of the trench rear wall.

13. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

the strikeface comprises a strikeface centerpoint;

the backface comprises a backface centerpoint opposite the strikeface centerpoint;

the port rib wall extends along the backface within 6 mm of the backface centerpoint;

and the trench bottom wall is closer to the outer sole surface than a top end of the trench rear wall.

14. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

the trench rear wall is non-parallel to the trench front wall;

and the trench bottom wall is closer to the outer sole surface than a top end of the trench rear wall.

15. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

and a port structure defined by the backface and by the sole, and configured to receive a tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter;

a trench rear wall, coupled to the trench bottom wall opposite the trench front wall, and subdividing the sole between the sole front section and the sole rear section;

a bottom front angle between the trench bottom wall and the trench front wall;

a bottom rear angle between the trench bottom wall and the trench rear wall;

and the bottom rear angle is greater than the bottom front angle;

and the trench bottom wall is closer to the outer sole surface than a top end of the trench rear wall.

16. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

a tuning element;

and a port structure defined by the backface and by the sole, and configured to receive the tuning element within a port perimeter of the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

when the tuning element is seated against the port base and bounded by the port rib wall, at least a majority of the trench rear wall is decoupled from the tuning element;

and the trench bottom wall is closer to the outer sole surface than a top end of the trench rear wall.

17. A golf club head comprising:

a strikeplate comprising:

a strikeface; and a backface opposite the strikeface;

a sole coupled to the strikeplate and comprising:

an outer sole surface;

an inner sole surface opposite the outer sole surface;

a sole front section; and a sole rear section;

a tuning element;

and a port structure defined by the backface and by the sole, and configured to receive the tuning element within a port perimeter of the port structure;

wherein:

the tuning element comprises:

a tuning element top end; and a tuning element bottom end;

the port structure comprises:

a port base at the backface and delimited by the port perimeter;

a port rib wall protruded from the backface and bounding an upper section of the port base along the port perimeter, and comprising a port rib wall rear end towards a rear of the golf club head; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

the port trench defines an insertion axis along which the tuning element can be inserted into the port trench unobstructed by the port rib wall, the insertion axis extending from the trench bottom wall and past the port rib wall without traversing through the port rib wall or the trench rear wall;

the tuning element is insertable along the insertion axis into a pivot position where:

the tuning element bottom end reaches the trench bottom wall; and the tuning element top end is closer to the sole than the port rib wall rear end;

and the trench bottom wall is closer to the outer sole surface than a top end of the trench rear wall.

18. The golf club head of claim 17, wherein:

when the tuning element is in the pivot position:

the tuning element is pivotable, along the trench bottom wall, to a secured position where:

a tuning element front end of the tuning element contacts the port base; and the tuning element top end is bounded by the port rib wall.

19. A golf club head comprising:

a strikeplate comprising:

a strikeface; and a backface opposite the strikeface;

a loft plane defined by the strikeface;

a sole coupled to the strikeplate and comprising:

an outer sole surface;

an inner sole surface opposite the outer sole surface;

a sole front section; and a sole rear section;

a tuning element; and a port structure defined by the backface and by the sole, and configured to receive the tuning element within a port perimeter of the port structure;

wherein:

a port rib wall is substantially non-orthogonal to the loft plane;

the strikeface comprises a strikeface centerpoint;

the backface comprises a backface centerpoint opposite the strikeface centerpoint;

the port rib wall extends along the backface within 6 mm of the backface centerpoint;

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

when the golf club head is at an address position relative to a ground surface, the trench bottom wall is closer to the ground surface than any point of the sole rear section along the inner sole surface;

a trench bottom rear angle between the trench bottom wall and the trench rear wall is greater than a trench bottom front angle between the trench bottom wall and the trench front wall;

when the tuning element is seated against the port base and bounded by the port rib wall, at least a majority of the trench rear wall is decoupled from the tuning element; and the tuning element is pivotable along the trench bottom wall, from a pivot position to a secured position where:

a tuning element front end of the tuning element contacts the port base; and the tuning element top end is bounded by the port rib wall.

20. The golf club head of claim 19, wherein:

a loft orthogonal axis extends orthogonal to the loft plane and intersects a junction between the backface and the port rib wall; and a port rib angle, from the port rib wall to the loft orthogonal axis, is approximately 10 degrees to approximately 40 degrees.

21. A method for providing a golf club head, the method comprising:

providing a strikeplate comprising:

a strikeface; and a backface opposite the strikeface;

providing a sole coupled to the strikeplate and comprising:

an outer sole surface;

an inner sole surface opposite the outer sole surface;

a sole front section; and a sole rear section;

providing a tuning element;

providing a port structure defined by the backface and by the sole, and configured to receive the tuning element within a port perimeter of the port structure; and coupling the tuning element to the port structure;

wherein:

the port structure comprises:

a port base at the backface and delimited by the port perimeter;

a port rib wall protruded from the backface and bounding an upper section of the port base along the port perimeter; and a port trench extending into the sole and comprising:

a trench front wall defined by a lower section of the port base at the backface of the strikeplate;

a trench bottom wall at the sole front section, coupled to the trench front wall and bounding the lower section of the port base along the port perimeter; and a trench rear wall, coupled to the trench bottom wall opposite the trench front wall, and subdividing the sole between the sole front section and the sole rear section;

the trench rear wall is non-parallel to the trench front wall; and the port rib wall is substantially non-orthogonal to a loft plane defined by the strikeface.

22. The method of claim 21, wherein:

when the golf club head is at address over a ground plane, the port rib wall is within ±35 degrees of being substantially parallel to the ground plane.

23. The method of claim 21, wherein:

the sole comprises:

a sole trench thickness of approximately 1.0 mm to approximately 5.1 mm, measured at the sole front section between the outer sole surface and the trench bottom wall; and a sole maximum thickness of approximately 2.5 mm to approximately 11 mm, measured at the sole rear section between the outer sole surface and the inner sole surface.

24. The method of claim 21, wherein:

the strikeface comprises a strikeface centerpoint;

the backface comprises a backface centerpoint opposite the strikeface centerpoint; and the port rib wall extends along the backface within 6 mm of the backface centerpoint.

25. The method of claim 21, wherein:

the port trench defines an insertion axis along which the tuning element is insertable into the port trench unobstructed by the port rib wall, the insertion axis extending from the trench bottom wall and past the port rib wall without traversing through the port rib wall or the trench rear wall;

and coupling the tuning element to the port structure comprises:

inserting the tuning element along the insertion axis into a pivot position where:

a bottom end of the tuning element reaches the trench bottom wall; and a top end of the tuning element is closer to the sole than a rear end of the port rib wall;

and pivoting the tuning element, along the trench bottom wall, to a secured position where:

a front end of the tuning element contacts the port base; and the top end of the tuning element is bounded by the port rib wall.

* * * * *